US010155608B2

(12) United States Patent
Kranz et al.

(10) Patent No.: US 10,155,608 B2
(45) Date of Patent: Dec. 18, 2018

(54) THREADED TUBE AND THREADED LID FOR BIOMATERIAL

(71) Applicants: HELMHOLTZ ZENTRUM MÜNCHEN DEUTSCHES FORSCHUNGSZENTRUM FÜR GESUNDHEIT UND UMWELT (GMBH); GREINER BIO-ONE GMBH

(72) Inventors: Bernd Roman Kranz, Berg (DE); Sven Muhlfriedel, Frickenhausen (DE)

(73) Assignee: GREINER BIO-ONE GMBH

( * ) Notice: Subject to any disclaimer, the term of this patent is extended or adjusted under 35 U.S.C. 154(b) by 567 days.

(21) Appl. No.: 14/653,724

(22) PCT Filed: Dec. 17, 2013

(86) PCT No.: PCT/EP2013/076872
§ 371 (c)(1),
(2) Date: Sep. 11, 2015

(87) PCT Pub. No.: WO2014/095840
PCT Pub. Date: Jun. 26, 2014

(65) Prior Publication Data

US 2016/0031611 A1 Feb. 4, 2016

(30) Foreign Application Priority Data

Dec. 21, 2012 (DE) ..... 10 2012 025 254

(51) Int. Cl.
*B65D 41/04* (2006.01)
*B01L 3/00* (2006.01)

(52) U.S. Cl.
CPC ..... *B65D 41/04* (2013.01); *B01L 3/50825* (2013.01); *B01L 3/50853* (2013.01); *B01L 2300/042* (2013.01)

(58) Field of Classification Search
CPC .. B65D 50/067; B65D 41/04; B65D 41/0414; B65D 41/0407; B65D 41/0428;
(Continued)

(56) References Cited

U.S. PATENT DOCUMENTS 5,680,953 A * 10/1997 Baughman ..... B65D 39/082 220/288
2007/0104617 A1 5/2007 Coulling et al.
(Continued)

FOREIGN PATENT DOCUMENTS

EP 2479441 A1 7/2012
JP H07187206 A 7/1995
(Continued)

OTHER PUBLICATIONS

International Search Report and Written Opinion with English Translation from International Application No. PCT/EP2013/076872, dated Apr. 23, 2014 (14 pages).
(Continued)

*Primary Examiner* — Robert Poon
(74) *Attorney, Agent, or Firm* — Kagan Binder, PLLC

(57) ABSTRACT

The invention relates to a screw cap for sealing a screw top tube for biomaterial, wherein the screw cap has a cylindrical screw section, which has an external thread, wherein the cylindrical screw section determines a longitudinal axis, a flange portion, which connects to the screw section, a recess coaxial to the longitudinal axis, which extends through the flange portion and at least part way along the screw section, wherein the recess has an inner component profile that is suitable for opening and closing with an appropriate key, and wherein the inner component profile extends axially at least part way along the screw section.

15 Claims, 4 Drawing Sheets

Figure 1A:
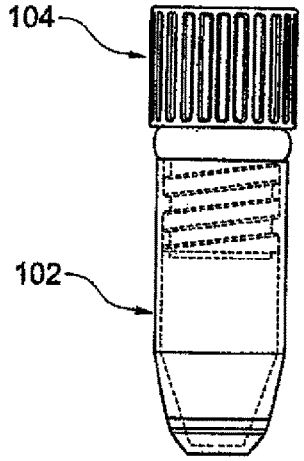
Fig. 1a Prior art

(58) Field of Classification Search
CPC ..... B65D 41/086; B65D 41/28; B65D 39/00; B65D 39/08; B01L 3/50825; B01L 3/50853
USPC ..... 220/297, 210, 288
See application file for complete search history.

(56) References Cited

U.S. PATENT DOCUMENTS

| | | | | |
|---|---|---|---|---|
| 2008/0019889 | A1* | 1/2008 | Rogers | A61B 19/34 422/292 |
| 2008/0035642 | A1 | 2/2008 | Esser et al. | |
| 2012/0187121 | A1 | 7/2012 | Luppi | |

FOREIGN PATENT DOCUMENTS

| | | | |
|---|---|---|---|
| WO | 0190731 | A2 | 11/2001 |
| WO | 2005/110600 | A2 | 11/2005 |

OTHER PUBLICATIONS

International Preliminary Report on Patentability with English Translation from International Application No. PCT/EP2013/076872, dated Jun. 23, 2015 (11 pages).
Office Action and English translation thereof from Japanese Application No. 2015-548441, dated Oct. 31, 2017 (8 pages).
Gene Bio-Application, "GeBAflex-tube Kit", Jan. 10, 2010, XP055469473, URL: http://www.geba.org/var/116/149971-dialysis.pdf (2 pages).

* cited by examiner

THREADED TUBE AND THREADED LID FOR BIOMATERIAL

SCOPE OF THE INVENTION

The present invention relates to a screw top tube for biomaterial, a screw cap for sealing such a screw top tube for biomaterial and a system with a screw top tube and a screw cap. The present invention also relates to a storage device to accommodate multiple types of screw top tubes.

PRIOR ART

In biological research, biological materials are often stored for a certain length of time. Depending on the rationale behind the research, these timeframes can span several years, sometimes even several decades (e.g. 30 years). Therefore, biomaterial is typically put into so-called tubes. These tubes are then sealed using a cap. The tubes and the cap can take the form of screw top tubes and screw caps, for example.

After biological material has been placed into the screw top tube and after the cap has been shut, the tubes are placed into appropriate storage devices or racks. These are then typically cooled for storage. The refrigeration temperature is variously set depending on each individual study. For storage over a long period of time in particular, such as several decades, it can be advantageous to set a very low temperature of −180° C., for example.

In recent years, various larger biomaterial banks, hereinafter called "biobanks", have been set up within the framework of so-called cohort studies. In these biobanks, multiple individual biological samples are stored at very low temperatures (approx. −180° C.) for a very long time (several decades). There are typically more than 100,000 individual samples, sometimes even more than 1,000,000, which are stored over several decades. Such storage can also take place by means of automation in particular in so-called high-throughput processes.

A reason for these biobanks for larger epidemiological cohort studies can be, for example, to observe representative populations over several decades. Biomaterial resources that are accessible on an international level can be used to analyse the causes of complex illnesses and their early diagnosis. One thing common to all such biobanks is that, in terms of analysis, many relatively small individual samples from different biomaterials are only ever used once. In other words, repeated cycles of thawing and deep-freezing should therefore be avoided. In all these biobanks, it is also desirable to maintain as low a storage temperature as possible for time periods spanning several decades. This helps to minimise any changes in the quality of the samples. Furthermore, a common feature of these biobanks is also to fully automate the analysis processes in the aforementioned high-throughput analysis process. Thus, the appropriate tubes for the biomaterial should be suitable for automation.

For example, a biobank is currently being set up in Germany, within the framework of the so-called "National Cohort", for the storage of 25 million samples at an average storage temperature of −180° C. in the gas phase of liquid nitrogen. This will be stored for over 30 years.

It is clear to the person skilled in the art that the implementation of such studies involves a significant amount of work. In particular, storing so many samples over the course of 30 years at such low temperatures leads to a high demand for both space and energy. Of course, there are also the associated high costs that come with that.

Therefore, the outstanding objectives of the present invention are to increase storage density and thus efficiency for biomaterial, whilst at the same time significantly decreasing the material and energy demand when storing biological material.

As described above, screw top tubes with screw caps are typically used for storing biomaterial. Examples of these prior art screw top tubes with screw caps are shown in FIGS. 1*a*-1*d*. In the present invention, it was established that the space in these prior art screw top tubes and screw caps is not ideal. In other words, in the prior art, more space and more material is used than are necessary. This leads to higher volume and measurements than is necessary, requiring biological samples to be cooled down and kept at low temperatures. Furthermore, the design of the familiar tubes also leads in part to artificial losses in biological sample material, which is undesirable.

It is therefore a further task of the present invention to overcome or reduce these prior art problems. In other words, it is one of the tasks of the present invention, therefore, to reduce space and material requirement by using screw top tubes for biomaterial, whilst keeping the same volume levels.

SUMMARY OF THE INVENTION

These problems have been solved by the screw top tube according to the invention for biomaterial; the screw cap according to the invention for sealing a screw top tube for biomaterial; the system according to the invention with a screw cap and a screw top tube; and the storage device for accommodating several screw top tubes.

A first aspect of the present invention relates to a screw cap for sealing a screw top tube for biomaterial. The screw cap can be interpreted as a screw and the tube as a nut. The screw cap has a cylindrical screw section, which has an external thread. Alternatively, this section can also be described as a threaded portion, which has at the very least a thread over one part of its length. This cylindrical screw section determines a longitudinal axis. Furthermore, the screw cap has a flange portion, which can be interpreted as screw head. This flange portion joins on to the screw section. Furthermore, the screw cap has a recess, which extends coaxially to the longitudinal axis of the screw cap. These recesses extend longitudinally through the flange portion and at least part way along the screw section. Furthermore, this recess has an inner component profile. This inner component profile is suitable for opening and closing with an appropriate key. Furthermore, this inner component profile extends axially at least part way along the screw section.

In other words, the inner component profile of the screw cap, or the turn lock, extends into a sealed cavity of the screw section that has the external thread.

For example, this can be provided by milling the inner component profile into a solid element that has the flange portion and the screw section.

In comparison with the prior art, this type of inner component profile can have a relatively small diameter of less than 5 mm—preferably less than 4 mm and particularly approx. 3.6 mm—especially when suited to high torques for opening and closing a screw top tube with the screw cap. The possibility of providing the inner component profile with a relatively small diameter is advantageous, as in this way a suitable thickness of material can be produced between the component profile and external thread. This thickness of the material should preferably be large enough to guarantee a suitable stability when transmitting force to the component profile and external thread at the same time. In other words, the aim is to keep the diameter of the inner component profile as wide as possible, without reducing the material thickness between the component profile and external thread by so much that there would not be enough stability when transmitting power simultaneously to the component profile and external thread. Within the framework of this limitation, the diameter of the component profile should therefore be as wide as possible in order to keep the contact surface between wrench and screw cap as large as possible. It has been shown that the above-mentioned proportions are advantageous in this regard.

The screw cap described previously allows a more compact and space-saving design than is possible with the prior art screw cap. It is also temperature-resistant and hardy enough to be ideal for storage in the gas phase of liquid nitrogen. The screw cap according to the invention therefore achieves the objects of the invention.

The component inner profile can extend axially from 30% to 99% of the screw section: preferably between 50% and 90%, then, most preferably, between 60% and 80% and particularly, over approx. 70%. Because of this, a sufficient contact surface can be achieved between the component profile and the key that is equally as large when compared to the prior art. Neither does it have the wasted space of the prior art screw cap, which did not use the screw section for the component profile. The coaxial length of the component profile has a close positive correlation with the sealing of the tube contents, as maximum torque and therefore the contact pressure are determined by the length of the component profile between the screw cap as screw and the tube as nut.

Furthermore, the screw section can have an external diameter that is substantially constant over the length.

The flange portion that corresponds to a screw head can be largely cylindrical and have a wider external diameter (e.g. 8.7 mm) than the screw section (5.95 mm). This enables the contact surfaces of the screw top tubes, in particular a screw top tube flange, and the screw cap flange to be identical for every single turning position and thus giving the tightest seal.

In particular, it is preferable to have the flange portion flush with the external diameter of a screw top tube. The protrusion of the screw cap flange over the screw section forms a circular contact area with the end section of the screw top tube, for example with the flange portion of the screw top tube. The width of the contact area codetermines the quality of thickness between the screw top tube contents and the screw top tube's environment.

Furthermore, it is preferable for the external thread to be designed so that the tube can be sealed in about one turn, such as 0.7 to 1.3 turns, most preferably in 0.9 to 1.1 turns. In this way, you can guarantee on the one hand to get a better lock on a corresponding tube or a suitable seal between the tube and a screw cap. On the other hand, the screw cap can also be developed to be particularly small and compact, which further contributes to a reduction in the size, volumes and material of the screw cap.

It is preferable for the screw cap to have a total length, longitudinally along a longitudinal axis, of between 5.2 mm and 8.0 mm, more preferably between 6.2 mm and 7.0 mm and most preferably between 6.5 mm and 6.7 mm, such as 6.6 mm. It has been shown that such dimensions guarantee a suitable compromise on the one hand between the shortest length possible and a good seal function on the other.

The total length of the screw cap is the sum of the length of the screw section and the flange portion. It is preferable for the ratio between the length of the screw section and the length of the flange portion to be between 1.4 and 3.4. More preferable is a length between 2.1 and 2.7, more preferably between 2.3 and 2.5., in particular approx. 2.4. When sealing a screw top tube, the flange portion typically protrudes over the screw top tube longitudinally. This directly adds to the total length of a system with a screw top tube and a screw cap. Therefore, it is most preferable to make the length of the flange portion as small as possible. At the same time, the flange portion is also integral to ensuring that the screw cap provides a good seal. Therefore, it cannot be set arbitrarily small. The aforementioned ratios are particularly suited to getting an appropriate balance between attaining a sufficient seal on the one hand and realising the smallest possible material and space requirement on the other.

It is a similar situation for the absolute length of the flange portion, which is typically between 1.4 mm and 2.4 mm. Preferably this should be between 1.7 mm and 2.1 mm, most preferably between 1.8 mm and 2.0 mm and particularly approx. 1.9 mm. The length or height of the flange is mainly sufficient, together with a knurled flange, to be able, in exceptional circumstances, to manually open the tube (normal case: automatic opening via automated "capper/decapper", if need be with a key). At the same time, the height of the flange can guarantee sufficient stability to transfer the required contact pressure on to the sealing ring between the flange and the circular widened upper tube end.

Longitudinally, the external thread can extend between 70% and 100%, preferably between 75% and 95%, then most preferably, between 80% and 90%, and for example, approx 85% of the length of the screw section. Once again, these dimensions have been shown to be particularly advantageous in terms of the seal function on the one hand and a small material and space requirement on the other.

Furthermore, it is preferable for the screw cap to comprise plastic and more preferably to be made completely from plastic. Most preferably, the screw cap comprises polypropylene and most preferably consists solely of this material. This material is especially suited to achieving a proper seal, even when there is a requirement for just a small amount of material and again at very low temperatures. The plastic should preferably be "medical grade" or "USP Class VI".

Furthermore, the screw cap should have an additional sealing ring, preferably from silicon and most preferably from TPE or TPV. A sealing ring like this can further improve the seal between the newly invented screw cap and a corresponding screw top tube. Flat rings are preferable where the tube at the top does not have a taper or chamfer. This type of seal is preferable as it is thinner.

The aforementioned tasks have also been solved by the screw top tube according to the invention for biomaterial. This screw top tube is designed in such a way to be sealed by the screw cap according to the invention. The screw top tube also has a hollow cylindrical section. This hollow cylindrical section has an internal thread. This internal thread is adapted for use with the screw cap's external thread. The hollow cylindrical section also determines the tube axis and the longitudinal direction of the tube. In addition, this screw top tube, in combination with the so-called screw cap in particular, is able to guarantee a suitable seal when simultaneously reducing material and space, particularly in low temperatures and when using liquid nitrogen.

Preferably, the screw top tube is suitable for storage at very low temperatures, such as −180° or even lower. The same is valid for the screw cap. For example, for the screw top tube it can be a cryogenic tube suitable for nitrogen.

The internal thread of the hollow cylindrical section extends along the length of the screw top tube near one end of the hollow cylindrical section. Vicinity is interpreted in this context as a gap of not more than 3 mm, preferably not more than 2 mm, most preferably not more than 1 mm and particularly not more than 0.5 mm. In other words, in comparison with the prior art, the internal thread is shifted further therefore into the vicinity of the hollow cylindrical section. A particularly suitable seal can be reached with the aforementioned screw cap with reduced length.

Furthermore, it is preferable for a flange portion to connect to one end of the hollow cylindrical section. A flange portion of this type, which can have a much larger surface area further facilitates the seal between the screw top tube and the screw cap.

The screw top tube should preferably feature some plastic and more preferably be made completely from plastic. More preferably the screw top tube should feature polypropylene and most preferably be made from it entirely.

Furthermore, objects underlying the invention are also achieved by a system with a screw cap and a screw top tube, as described previously.

With such a system, it is particularly preferable for the screw cap to comprise at least one of the materials that the screw top tube has. Most preferably, the screw cap should be formed from the same material or materials as the screw top tube.

This can have the added advantage that screw top tubes and screw caps have the same or at least similar temperature expansion properties. This is particularly important given that screw caps and screw top tubes can be used in very low temperatures, such as −180° C. Also by choosing the same material and with the same or similar temperature properties, such as the coefficient of thermal expansion for example, a proper seal is guaranteed with minimal material requirements and minimal demand for space.

Furthermore, the problems underlying the invention are also solved by a storage device according to the invention to accommodate multiple screw top tubes according to the invention. This device is adapted such that the screw top tubes, stored longitudinally, stops flush with a flat end section of the storage device. This flush end should preferably be adapted so that there is a gap between a lower end of the stored screw top tubes and the flat end section of the storage device. This gap should be smaller than 3 mm, preferably smaller than 2 mm and more preferably less than 1 mm, such as approx. 0.6 mm.

In other words, the sides of the storage device or rack are not as high in comparison with the prior art. Stored longitudinally, the screw top tubes or the tubes therefore come up to the height of the contact area of the storage device or the racks. This helps to reduce the space requirement in the present invention.

To summarise, the present invention therefore prevents the loss of space. This leads to the reduction in space requirement and a gain in storage efficiency. Furthermore, this goes hand in hand with a reduction of the required cooling capacity, e.g. the whole cooling system can be of a smaller size and design. In particular cases, this can come with significant financial advantages: for example, the decrease in primary investment costs for storing nitrogen, whether it be manual or automatic; the decrease in equipment maintenance and repair costs; as well as the decrease in operations and in particular energy costs. The present invention is therefore also of economical benefit, as less volume and mass has to be cooled whilst using less energy and expelling less $CO_2$.

Alternatively or additionally, the invention includes the following aspects:

1. Screw cap for sealing a screw top tube for biomaterial, wherein the screw cap comprises
   a cylindrical screw section, comprising an external thread, wherein the cylindrical screw section determines a longitudinal axis,
   a flange portion, which connects to the screw section,
   a recess coaxial to the longitudinal axis, which extends longitudinally through the flange portion and at least part way along the screw section,
   wherein the recess has an inner component profile that is suitable for opening and closing with an appropriate key,
   wherein the inner component profile extends axially at least part way along the screw section.
2. Screw cap for sealing a screw top tube for biomaterial according to aspect 1, wherein the inner component profile extends axially between 30% and 99%, preferably between 50% and 90%, most preferably between 60% and 80% and particularly over approx. 70% of the screw section.
3. Screw cap for sealing a screw top tube for biomaterial according to one of the preceding aspects, wherein the screw section has a mainly constant external diameter.
4. Screw cap for sealing a screw top tube for biomaterial according to one of the preceding aspects, wherein the flange portion is essentially cylindrical and has a larger external diameter as the screw section.
5. Screw cap for sealing a screw top tube for biomaterial according to one of the preceding aspects, wherein the external thread is designed for just one turn, preferably 0.7 to 1.3 turns and more preferably 0.9 to 1.1 turns.
6. Screw cap for sealing a screw top tube for biomaterial according to one of the preceding aspects, wherein the screw cap has longitudinally along the longitudinal axis a total length between 5.2 mm and 8.0 mm, preferably between 6.2 mm and 7.0 mm, more preferably between 6.5 mm and 6.7 mm and particularly 6.6 mm.
7. Screw cap for sealing a screw top tube for biomaterial according to one of the preceding aspects, wherein the total length of the screw cap is the sum of the length of the screw section plus the flange portion, and wherein the ratio between the length of the screw section and the length of the flange portion is preferably be between 1.4 and 3.4, more preferably between 2.1 and 2.7, most preferably between 2.3 and 2.5 and particularly be approx. 2.4.
8. Screw cap for sealing a screw top tube for biomaterial according to one of the preceding aspects, wherein the length of the flange portion lies between 1.4 mm and 2.4 mm, preferably between 1.7 mm and 2.1 mm, most preferably between 1.8 mm and 2.0 mm and particularly approx. 1.9 mm.
9. Screw cap for scaling a screw top tube for biomaterial according to one of the preceding aspects, wherein the external thread extends longitudinally from 70% to 95%, preferably from 75% to 92%, more preferably from 80% to 90%, such as approx 85% of the length of the screw section.
10. Screw cap for sealing a screw top tube for biomaterial according to one of the preceding aspects, wherein the screw cap comprises plastic and preferably polypropylene, made more preferably from plastic and preferably from polypropylene.
11. Screw cap for sealing a screw top tube for biomaterial according to one of the preceding aspects, wherein the screw cap also has a sealing ring, preferably from silicon and most preferably from TPE or TPV.

12. Screw top tube for biomaterial that is designed to be sealed by a screw cap according to one of the preceding aspects, wherein the screw top tube has a hollow cylindrical section with an internal thread that is designed to be engaged with the external thread of the screw cap, and wherein the hollow cylindrical section determines a tube axis and a tube longitudinal direction.
13. Screw top tube for biomaterial according to aspect 12, wherein the internal thread of the hollow cylindrical section extends longitudinally of the screw top tube in vicinity of the end of the hollow cylindrical section, wherein vicinity in this context means a gap of not more than 3 mm, preferably not more than 2 mm, most preferably not more than 1 mm and particularly not more than 0.5 mm.
14. Screw top tube for biomaterial according to aspect 12 or 13, wherein a flange portion connects to the end of the hollow cylindrical section.
15. Screw top tube for biomaterial according to aspect 12 to 14, whereby the screw top tube features plastic and preferably polypropylene, most preferably is made from plastic and preferably from polypropylene.
16. System with a screw cap according to one of the aspects 1 to 11 and one screw top tube according to aspects 12 to 15.
17. System, wherein the screw cap features one of the materials of the screw top tube, and preferably, is made from the same material as the screw top tube.
18. Storage device for accommodating multiple screw top tubes according to one of the aspects 12 to 15, wherein the device is designed in such a way that the screw top tubes stored longitudinally stop flush with a flat end section of the storage device and preferably in such a way that there is a gap between the stored screw top tubes and the flat end section of the storage device. The gap should be smaller than 3 mm, preferably smaller than 2 mm and more preferably 1 mm, such as a gap of approx. 0.6 mm.

Everything described above and below, as well as any additional features and elements, can be used separately or in combination with other features and elements. Described below in detail are just some examples of the present invention, in which many of these additional features and elements are used both separately and in combination with each other, with reference to the attached drawings. The detailed description should merely serve to give the person skilled in the art further details of how preferred aspects of the present invention can be realised, and should not restrict the invention's scope of protection, which is defined by the patent claims. Therefore, combinations of features and steps represented in the following detailed descriptions are, in the broadest sense, not necessarily required to realise the invention and are therefore only represented in certain descriptions of some of the given examples of the invention. Moreover, various features of the given examples can be combined with the dependent requirements, which are not specifically described, in order to provide useful embodiments of the present invention.

Figure 1B:
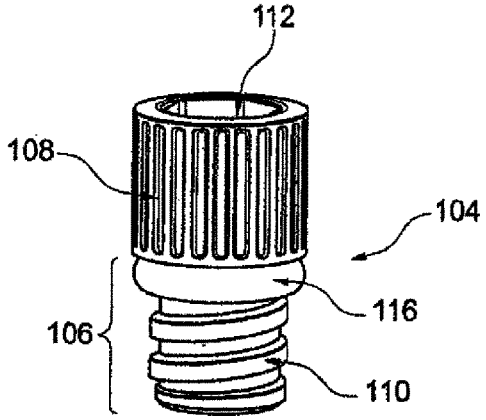
Fig. 1b Prior art
Figure 1C:
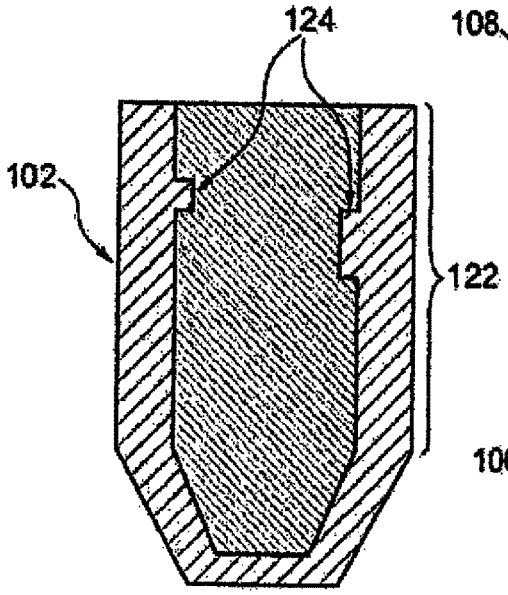
Fig. 1c Prior art
Figure 1D:
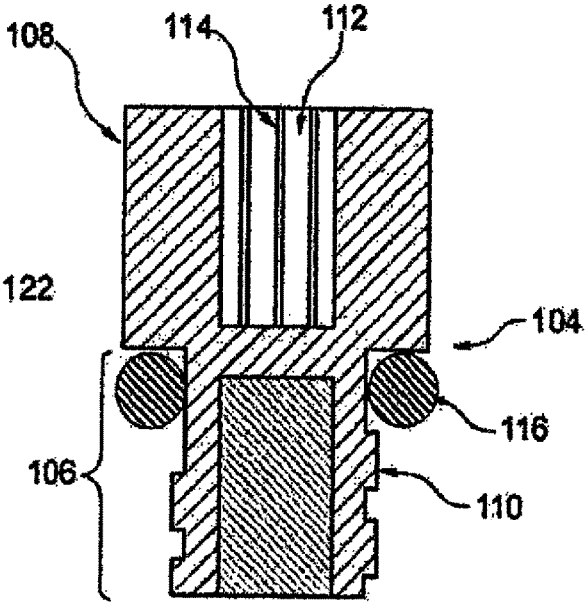
Fig. 1d Prior art
Figure 2:
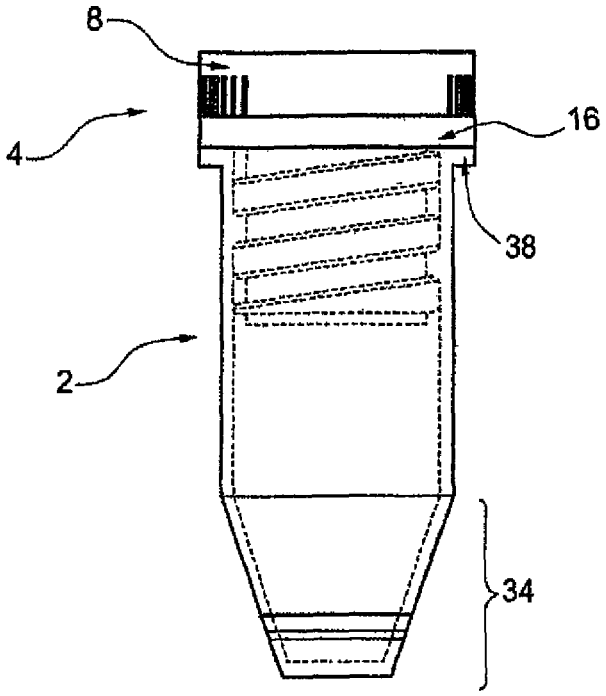
Figure 3:
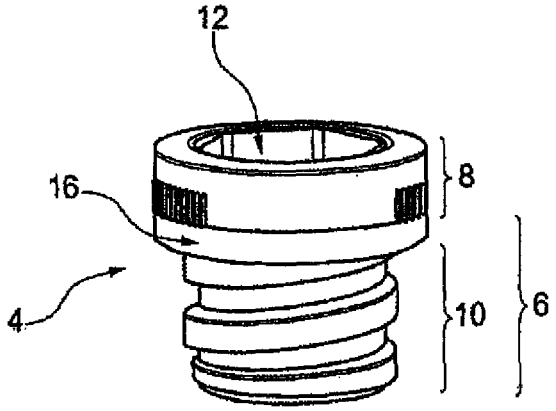
Figure 4:
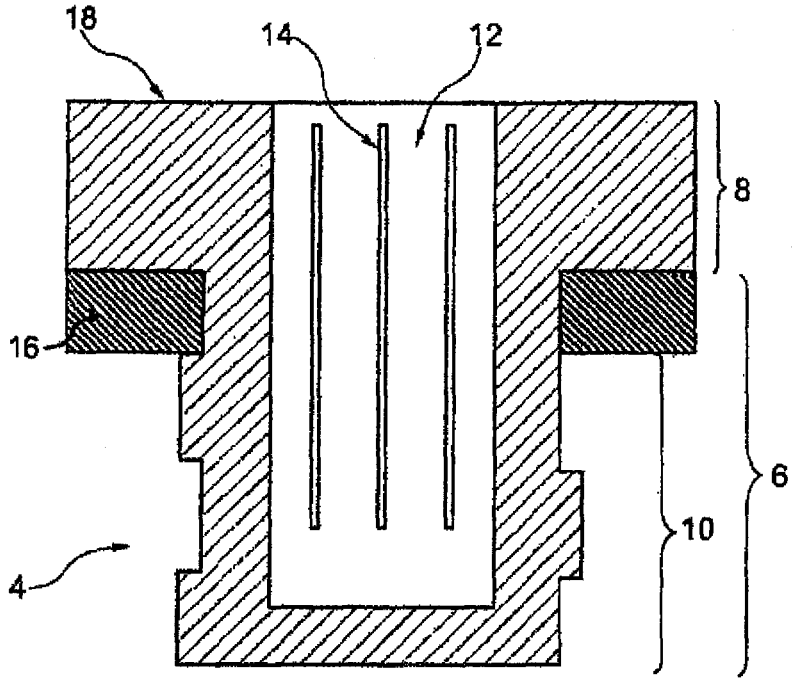
Figure 5A:
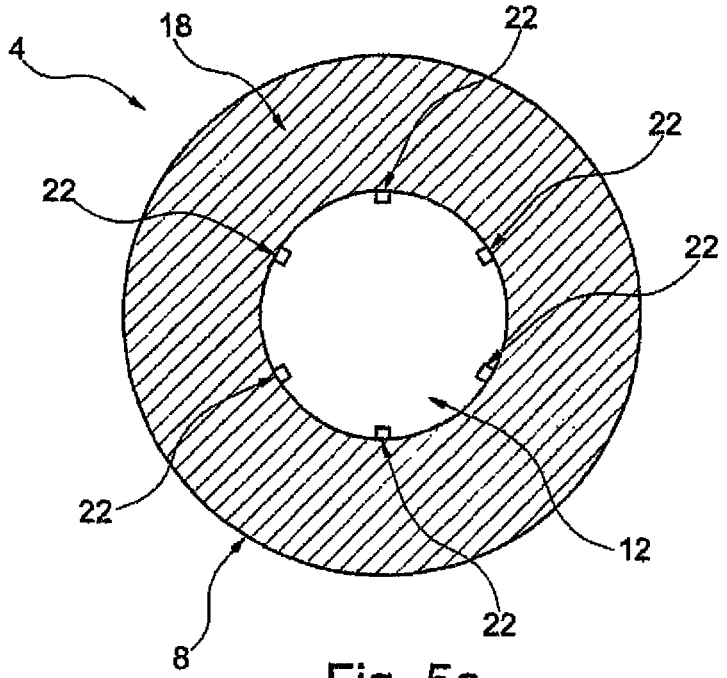
Figure 5B:
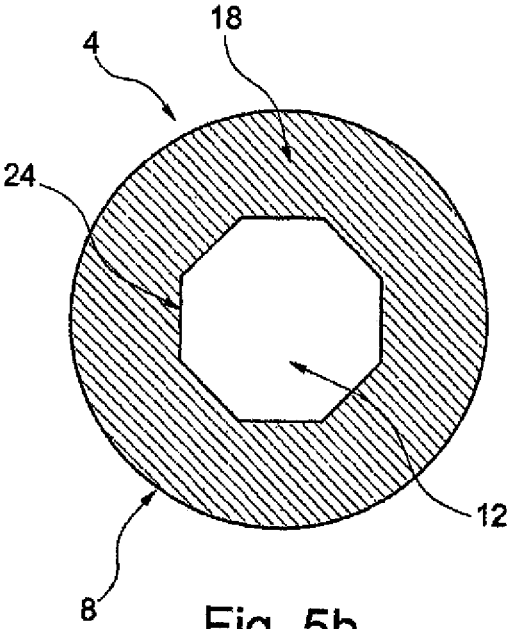
Figure 5C:
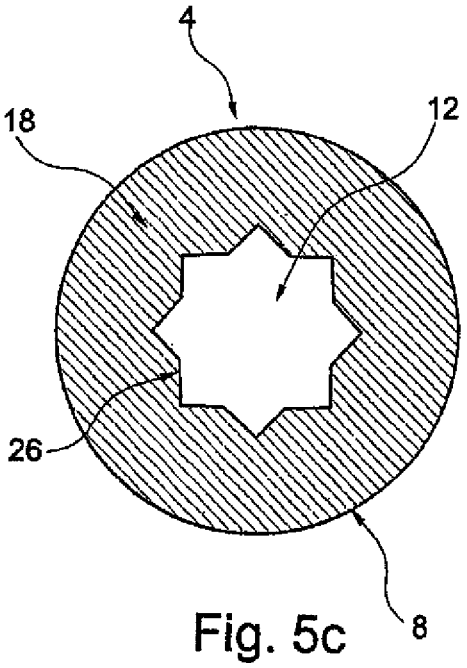
Figure 6:
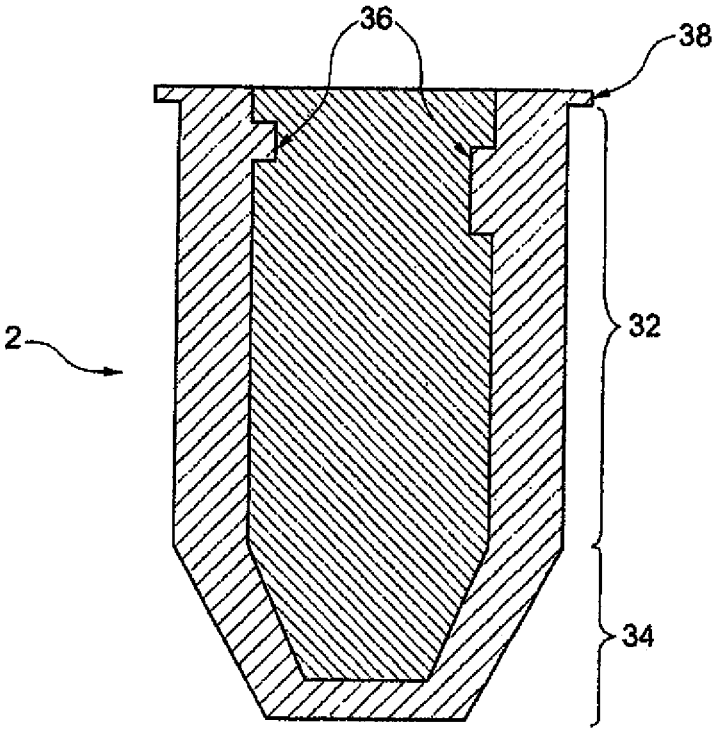

Subsequently, the features and advantages of the existing invention are explained by means of preferred embodiments with reference to the figures. These are merely for illustration purposes and should therefore not restrict the invention. In the process they show:

FIG. 1*a* a side view of a screw top tube for biomaterial with a screw cap from the prior art;

FIG. 1*b* a side view of a screw cap for sealing a screw top tube for biomaterial from the prior art;

FIG. 1*c* a schematic section view of a screw top tube for biomaterial from the prior art;

FIG. 1*d* a schematic section view of a screw cap for sealing a screw top tube for biomaterial from the prior art;

FIG. 2 a side view of a screw top tube for biomaterial with a screw cap according to a first embodiment of the invention;

FIG. 3 a side view of a screw cap for sealing a screw top tube according to an embodiment of the invention;

FIG. 4 a schematic section view of a screw cap for sealing a screw top tube according to an embodiment of the invention;

FIG. 5*a*-5*c* schematic top view from above on screw cap for sealing a screw top tube for biomaterial according to an embodiment of the invention; and FIG. 6 a schematic section view of a screw top tube for biomaterial according to an embodiment of the invention.

FIGS. 1*a*-1*d* show screw top tube 102 for biomaterial and the corresponding screw cap 104 for sealing the screw top tube from the prior art.

The screw cap 104 has a screw section 106 and a protruding section 108. Furthermore, the screw cap 104 has a sealing ring 116 made from silicon. The screw section 106 has an external thread 110. The protruding section, which can be seen as a type of head screw, has two forms, both of which can be used for opening. On the outside, there is a high knurl to open manually and on the inside, there is a recess for opening with a wrench.

Furthermore, screw cap 104 from the prior art has a recess 112, which extends coaxially to the longitudinal axis of the screw cap. This recess 112 is arranged in the protruding section 108 and has an inner component profile, which is provided by the lines 114. This inner component profile 114 extends along recess 112 and therefore only along protruding section 108.

Furthermore, screw top tube 102 for biomaterial is also known from the prior art. The screw top tube 102 is designed to be sealed by the screw cap 104. The screw top tube 102 here has a hollow cylindrical section 122 with an internal thread 124. The internal thread 124 is typically several millimeters away from the open end of the hollow cylinder 122.

According to FIGS. 2, 3, 4, 5*a*, 5*b* and 5*c*, the screw cap 4 according to the invention is different from the screw cap 104 from the prior art. Even so, according to FIGS. 2 and 6, the newly invented screw top tube is different from the screw top tube 102 from the prior art.

Screw cap 4 is suitable for sealing a screw top tube 2 for biomaterial. The screw cap 4 has a screw section 6. This screw section 6 is preferably cylindrical and has an external thread 10 on a longitudinal end. Furthermore, screw section 6 determines a longitudinal axis.

The screw cap 4 according to the invention also has a flange portion 8 that connects to screw section 6. The flange portion can be interpreted as the head screw with low knurling. The flange portion 8 can essentially be formed as a cylinder. Apart from external thread 10, screw section 6 mainly has a constant external diameter. Even so, flange portion 8 typically has a constant external diameter that is larger than screw section 6's diameter. This can be seen among others things in FIGS. 3 and 4.

FIG. 4 here shows a schematic section view of a screw cap 4 according to the invention. The roughly hatched area shows here the sectional plane through the screw cap 4. Area 12 shows an area of the screw cap 4 that has been replaced in relation to the sectional plane. In FIGS. 1*c*, 1*d*, and 6, concerning the cutting surface, those areas with fine hatching have been replaced. Furthermore, regarding the cutting surface, recess 112 in FIG. 1*d* and recesses 12 in FIGS. 5*a* to 5*c* have also been replaced.

From FIGS. 3, 4 and 5*a*-5*c*, it is also apparent that the screw cap 4 has a recess 12. As is apparent in FIG. 4, this recess 12 passes coaxially to the longitudinal axis, which is determined by the cylindrical screw section 6. As is also quite apparent from FIG. 4, the recess extends longitudinally both through the flange portion 8 and at least part way along the screw section 6.

Furthermore, recess 12 has an inner component profile that is indicated in FIG. 4 by lines 14. This inner component profile is designed or is suitable for opening and closing with an appropriate key. This inner component profile extends further, as indicated by structures 14, axially at least part way along screw section 6.

Furthermore, it is preferable for the inner component profile also to extend at least part way along flange portion 8.

According to an embodiment, this inner component profile can extend along the whole length of recess 12. That means specifically along the whole section of recess 12, which extends along flange portion 8 and along the whole of the section, which extends along screw section 6.

It also allows a further embodiment but also ensures that the inner component profile does not extend along the whole of flange portion 8 but instead ends spaced from one end of flange portion 8, in particular spaced from an upper surface or upper side 18 of flange portion 8. When in use, i.e. when screw cap 4 is screwed onto a screw top tube 2, recess 12 is only open on one side, namely on the outside. It is, however, not on the inside and therefore not on the side of the inner volume of the screw top tube.

As a result of the aforementioned measures, material costs for the tube and cap according to the invention are reduced. Furthermore, artificial sample losses can also be prevented or reduced. These can be used in particular to reduce or prevent the fact that screw section 6 does not have a side-opening recess that faces the flange portion longitudinally, i.e. has no hollow space positioned in the inner space of the tube when in use. This is the case for the prior art screw cap where liquid can collect in it and be wasted when opening.

In other words, screw cap 4 can be also be interpreted as a screw top that in its basic form corresponds to a screw. The tube 2 corresponds to a nut. External thread 10, which can also be described as a screw top external thread, corresponds then to a screw thread. This can set up a connection with the corresponding internal thread 36 from tube 2 which is the same as the screw nut thus guaranteeing, with sealing ring 16 in particular, a proper seal, for example for a sample.

FIGS. 5*a*-5*c* show possible designs of the inner component profile, in each case showing a top view from above of the screw cap 4 according to the invention. The hatched area 18 shows upper area or upper side 18 of flange portion 8. Recess 12 is not hatched in these figures. According to FIG. 5*a*, the inner component profile can be formed with corresponding bars 22. Although there are six such bars shown in FIG. 5*a*, it is clear to the man skilled in the art that they can just as equally use 3, 4, 5, 7, 8 etc. bars. Equally, it is possible that corresponding exceptions are put in their place (not shown) instead of bars 22.

According to FIGS. 5*b* and 5*c*, the inner component profile can result from the corresponding recess 12 design. According to FIG. 5*b*, recess 12 as a polygon is, for example, formed here as an octagon 24. It is also clear to the person skilled in the art that they can arbitrarily choose from various, preferably regular, polygons.

FIG. 5*c* shows another possible design of the inner component profile as an eight-pointed star 26. For the man skilled in the art it is also clear that the invention is not just restricted to an eight-pointed star and that various four-pointed stars can be used instead.

Furthermore, the integrated component profile can also be designed as a Torx inner profile (a type of Star of David with six points) or as a Torx Plus inner profile. These component profiles, as with the other descriptions, are suitable to be used for opening with an appropriate wrench with external profile. The Torx profile and particularly the Torx Plus profile, for example, also allows a simplified set up of a wrench in an automated capper/decapper system, in particular also a good energy transmission with high torque. Through these profile designs, an inner component profile that has suitable energy transmission can be designed to be relatively short, which further reduces the tube cap's material and space requirements. Through a high energy or torque transmission, the screw top external thread can have a relatively short design. This can lead to an increase of the tube inner volume with the same external height or a reduction of external height with the same tube inner volume.

Furthermore, a high-energy transmission with high torque can in general also positively influence the closing and sealing properties between the tube's external thread 10 and internal thread 36 and therefore allow the design to be relatively short, for example, with just one turn. This can cause a further shortening of the whole length at the same filling volume (or a higher filling volume with the same total length).

In general, the inner component profile can preferably be interpreted as being an inner profile facing externally. This can be opened and closed with a capper/decapper wrench. The design is particularly suitable for an automated operation and is ideal for replacing a high design of the protruding section with an inner profile, as with the prior art.

Although various preferred embodiments of the inner component profile were shown above, any non-cylindrical design of the inner component profile that enables the opening and closing with an appropriate key is generally suitable. Preferably suited are those, however, that allow a good energy transmission with high torque.

FIGS. 2, 3 and 4 show a sealing ring 16 that preferably encloses screw section 6. Sealing ring 16 is typically located in the area of the screw section that does not have external thread 10. It is preferable for the sealing ring 16 to be made from silicon and more preferably from TPE or TPV. When in use, this sealing ring 16, as shown in FIG. 2, lies between flange portion 8 of screw cap 4 and flange portion 38 of screw top tube 2 in order to seal both elements against each other. Sealing ring 16 closes (as best seen in FIG. 4) in circumferential direction, which goes vertically longitudinally, preferably flush with flange portion 8. It is also preferable for the sealing ring to be used with a tube 2 flush with an external edge of tube 2, for example, flush with a flange portion 38.

As previously mentioned, the newly invented recess 12 and the corresponding inner component profile extends axially at least part way along screw section 6. This contributes to or enables a compact and space-saving design of the newly invented screw cap 4. The inner component profile can extend axially from 30% to 99%, preferably from 50% to 90% and more preferably from 60% to 80%, such as approx. 70% of the screw section. A suitable choice of these parameters contributes on the one hand to space gain, but on the other hand also allows a sufficient stability of the screw cap and in particular the screw section. In particular, it is preferable to ensure that screw cap 4 can withstand very low temperatures for a very long time period, without deterioration.

As shown in FIGS. 3 and 4, screw section 6 of screw cap 4 has an external thread 10. This is typically located longitudinally at the end of screw section 6. It is preferable for this external thread 10 to be designed for about one turn, such as 0.7 to 1.3, and more preferably 0.9 to 1.1 turns. This design for just a small number of turns contributes further to the compact design and therefore to space gain. The pitch of the thread also plays a role.

Screw cap 4 is typically made from plastic and preferably from polypropylene. This guarantees a lightweight construction for screw cap 4. Furthermore, this material is so durable that it enables simple and compact construction of screw cap 4 and therefore contributes further to the compact design of screw cap 4.

A further aspect of the invention relates to a screw top tube 2 for biomaterial—see here primarily FIGS. 2 and 6. This screw top tube 2 is designed to be closed by a screw cap 4 as described previously. Screw top tube 2 has a hollow cylindrical section 32. Furthermore, screw top tube 2 can also have a tapering section 34 that is joined onto the hollow cylindrical section 32, which tapers with increasing distance from hollow cylindrical section 32. Furthermore, hollow cylindrical section 32 has an internal thread 36. This internal thread is designed to be used with external thread 10 of screw cap 4 described previously. Furthermore, hollow cylindrical section 32 of screw top tube 2 determines a tube axis and a longitudinal direction of the tube.

It is preferable for internal thread 36 of the screw top tube 2 to be designed for about one turn, preferably for 0.7 to 1.3 turns and more preferably for 0.9 to 1.1 turns.

As previously described, the screw cap 4 according to the invention has a relatively compact design. In particular, thread 10 can only extend from 3 to 5 mm, for example approx. 3.9 mm. Among other things, in order to guarantee safe operation between external thread 10 of screw cap 4 and internal thread 36 of hollow cylindrical section 32, it is preferable that internal thread 36 of hollow cylindrical section 32, which is part of the screw top tube 2, extends along the length of screw top tube 2 in the vicinity of one end of hollow cylindrical section 32. Vicinity should in this context be a gap of not more than 3 mm, preferably not more than 2 mm, most preferably not more than 1 mm and particularly not more than 0.5 mm. This is represented in FIG. 6, in which internal thread 36 extends up close to the upper end of hollow cylindrical section 32. At this end, the screw top tube 2 generally has an open end.

Furthermore, it is also preferable for a flange portion 38 to connect to one end of the hollow cylindrical section 32 of screw top tube 2. For example, this can lead to an enlargement, which further facilitates a seal between the screw top tube 2 and the screw cap 4.

The screw top tube typically comprises plastic and is more preferably made from plastic or consists of it. A typical plastic to use for this is polypropylene.

The invention also comprises, as shown for example in FIG. 2, a system that has on the one hand a screw cap 4 and on the other a screw top tube 2. It is preferable in this system for screw cap 4 and screw top tube 2 to comprise the same materials and more preferably to be made from the same materials. This can therefore have the advantage, for example, of having the same or similar temperature expansion coefficients, in this case for tube 2 and cap 4. This can then be particularly important when tubes and samples are used in very low temperatures. In this way, even under extreme conditions, it is possible to achieve an appropriate seal between tube 2 and cap 4. This also gives tube 2 and in particular cap 4 an especially compact design.

As indicated in FIGS. 2 and 6 in particular, screw top tube 2 has a tapered section 34 on one lower end. This enables the application of tube 2 in an appropriate storage device and further aids clean (where possible) sample application when pipetting the contents. A further aspect of the invention refers to this storage device. Such a storage device is typically designed for the application of multiple screw top tube 2.

Furthermore, the device according to the invention is designed in such a way that screw top tube 2 stored longitudinally ends more or less flush with the flat end section of the storage device. Preferably, this flush end is such that there is a gap between the screw top tube 2 and the flat end section of the storage device. This gap is less than 3 mm, preferably less than 2 mm and more preferably less than 1 mm. For example, the gap can be approx. 0.6 mm. A storage device of this type for screw top tube 2 contributes further to the compact design for storing screw top tubes 2 and reducing the required space for it even more.

NUMERICAL COMPARISONS OF AN EMBODIMENT WITH THE PRIOR ART

Below, an embodiment of the screw cap according to the invention and the screw top tube according to the invention is compared with a prior art screw cap and a screw top tube. For the screw top tubes or prior art tubes, these are the 0.5 ml Screw Cap Tube from Micronic. Table 1 shows the measurements of a prototype of the present invention in comparison with the "0.5 ml Screw Cap Tube" from Micronic.

TABLE 1

Comparison of the prototype measurements from the present invention with an example from the prior art.
All measured values for 1. and 2. were calculated with a calliper, 3.1. was calculated by pipetting water, 3.2. by multiplying 3.1. by a factor of 0.917149.

| | Parameter abbreciations are "tube" for "screw top tube", "cap" for "screw cap" | | Micronic 0.5 ml Screw Cap Tube | |
|---|---|---|---|---|
| | | The Present Invention | Manufacturer Information | Own measurement |
| 1. | Height or length longitudinally | | | |
| 1.1. | mm cap or tube height | 14.7 | 18.5 | 18.49 |
| 1.2. | mm cap height | 6.6 | 14.3 | 14.2 |

TABLE 1-continued

Comparison of the prototype measurements from the present invention with an example from the prior art.
All measured values for 1. and 2. were calculated with a calliper, 3.1. was calculated by pipetting water, 3.2. by multiplying 3.1. by a factor of 0.917149.

| | Parameter abbreciations are "tube" for "screw top tube", "cap" for "screw cap" | The Present Invention | Micronic 0.5 ml Screw Cap Tube Manufacturer Information | Own measurement |
|---|---|---|---|---|
| 1.2.1. | mm height screw section of the cap | 4.68 | 7.1 | 7.25 |
| 1.2.1.1. | mm sealing ring height as per 1.2.1. | 0.7 | | 1.75 |
| 1.2.2. | mm height of the flange portion or protruding section of the cap (measured according to distance to the sealing ring) | 1.9 | 7.2 | 6.95 |
| 1.2.3. | mm inner height of the component profile | 5.2 | | 5.99 (edge) −6.82 (centre) |
| 1.2.4. | mm overlap of the component profile with the screw section longitudinally (determined from 1.2.3. and 1.2.2.) | 3.3 | | 0 |
| 1.3. | mm total height of the tube with detached cap | 17.3 | 26.5 | 26.2 |
| 1.4. | mm total height of the tube with cap in storage device | 17.9 | 29.5 | 29.5 |
| 2. | | Diameter | | |
| 2.1.1. | mm inside diameter of the tube on the upper end | 6.18 | | 6.80 |
| 2.1.2. | mm external diameter of the tube on the upper end | 8.66 | | 8.66 |
| 2.2.1. | mm diameter of the screw section of the cap | 5.95 | | |
| 2.2.2. | mm diameter of the flange part of the cap | 8.67 | | 8.4 |
| 2.2.3. | mm inside diameter of the component profile | 3.66 | | 5.56-6.76 |
| 3. | | Volumes | | |
| 3.1. | µl max. filling volume to lower edge of the cap's external thread | 220 | | |
| 3.2. | µl max. working volume at room temperature, calculated from 3.1. | 202 | 190 | |

The height of the screw top tube without the screw cap is the first value to be measured (1.1.). Although the screw top tube can take in more or less the same liquid volume, the screw top tube of the prototype of the invention is already 3.8 mm shorter than the prior art screw top tube. This is, among other things, down to the more compact design of the newly invented screw cap and in particular, the more compact design of the external thread of the screw cap. Because of this, less volume of the screw top tube is required to include the external thread of the screw cap. This means the screw top tube is not as high but has more or less the same working volume.

Furthermore, the screw cap in accordance with the prototype of the invention, according to parameter 1.2., is significantly shorter than the prior art screw cap. This is achieved by the measures as discussed in the earlier general descriptions section and in the descriptions of the figures.

According to parameter 1.2.2., the flange portion of the present prototype has a height of approx. 1.9 mm longitudinally, as opposed to approx. 7.0 mm for the protruding section from the prior art. This leads to a further reduction in the total height of the screw top tube with screw cap, when this screw cap is screwed tight, as reflected in parameter 1.3. in the above table.

For more information, see the previously discussed storage device according to the invention. This is in particular designed so that the screw top tube ends more or less flush with an end section of the storage device. According to the embodiment shown in the above table, this means specifically that the total height of the screw top tube with screw cap in the storage device (1.4.) is only slightly (and in the present example only by 0.6 mm) bigger than the total height of the detached screw top tube with screw cap (1.3.). In comparison with this, the prior art has an additional gap of 3.3 mm.

The last two parameters in Table 1 above show the filling volume of the tube. For the screw top tube, according to an embodiment of the present invention, here the maximum working volume is the result of the maximum filling volume calculated from pipetting up to the lower edge of the screw section of the screw cap divided by a factor of 1.0903355. This takes account of the fact that watery liquid, which is typically filled at room temperature in the screw top tube, will expand when the water content is frozen.

Furthermore, manufacturer information and own measurements show that screw section 106 with external thread 110 in the conventional screw top from Micronic extends over 7.1 mm (manufacturer information) or 7.25 mm (own measurement) (see FIGS. 1*b* and 1*d*) and the protruding section 108 with recess 112 and inner component profile 114 extends over 7.2 mm (manufacturer information) or 6.95 mm (own measurement). This means that those parts represent approximately 50% of the total of the screw top or screw cap 104. On the other hand, for the screw top tube, according to an embodiment of the present invention, flange portion 8 accounts for less than 30% of the total length of the screw cap, particularly since the inner component profile overlaps here longitudinally with the screw section, as reflected in parameter 1.2.4.

For more information, see parameters 2.1.1. and 2.1.2. According to these, a longitudinal end (the upper end) of the newly invented prototype tube forms a (8.66 mm-6.18 mm):2=1.24 mm wide ring or a flange portion, which represents a contact area and therefore a sealing surface between the tube, screw cap and a sealing ring in between them. This material ring is wider than in the prior art. Together with the torque and the material of the sealing ring, this sealing surface determines the grade of seal from the tube contents to tube environment. Through its improved seal, this design can also, for example, contribute to the design of a shorter thread without the overall sealing effect being significantly impaired, and therefore can contribute to material and space saving.

From 2.2.1. and 2.2.3. it results in a strength of wall of the screw section between thread and component profile, i.e. a strength in the component profile wall in the screw section area of (5.95 mm-3.66 mm): 2=1.15 mm which further contributes to a suitable thread stability and enables or supports the overlap between inner component profile and screw section.

In addition, the part of the external thread of the screw cap, which when used is directed to the inner volume of the tube, is hollow down to the inner volume of the tube in the prior art from Micronic. This hollow space is on the one hand unusable and therefore wasted space when storing samples. On the other hand, it is at the same time an artefact source in so far as liquid tube contents (before or after possible deep freezing) get into this hollow space, for example from shaking.

In comparison with the above dimensions from the familiar prior art screw caps, the height of the screw cap according to the embodiment of the invention is only 6.6 mm, thus reduced by 54% when compared with the prior art from Micronic. The significant reduction of this height has, among other things, been achieved by the overlap longitudinally between the screw section with external thread on the one hand and the recess with inner component profile on the other hand.

As a result, the space requirement of the tube according to the invention in the storage device has been reduced by over 39% when compared to the prior art from Micronic. This leads to a significant reduction of the space requirements and/or the number of storage containers. These samples typically have to be cooled, and indeed compared to room temperature by up to 210°, leading directly to a reduction of the volume or mass that requires cooling. Therefore, less nitrogen has to be used for cooling and indeed in epidemiological cohort studies over the time period of 20 to over 30 years. The significant reduction of energy use (and therefore also energy costs) runs in parallel with a significant reduction of pollution within the framework of larger epidemiological cohort studies that span decades. Finally, in line with the reduced number and size of the storage vessels, the storage building including the site infrastructure for the storage (inc. safety provision and energy-intensive air conditioning of the space in which nitrogen is released) can be smaller than you would need for prior art screw top tubes and screw caps.

The invention also comprises the precise or exact terms, features, numerical values or areas etc. when previously or hereinafter these terms, features, numerical values or areas were named in connection with terms such as about, approx., by, essentially, at least, at least etc. (so about 1 should also 1 or largely constant should also include constant). The term or also means and/or.

The invention claimed is:

1. A system comprising a screw cap and a screw top tube for biomaterial which is adapted to be sealed by the screw cap, wherein the screw can comprises a cylindrical screw section comprising an external thread, wherein the cylindrical screw section has a longitudinal axis, a flange portion, which connects to the screw section, a recess coaxial to the longitudinal axis which extends longitudinally through the flange portion and at least part way along the screw section, wherein the recess comprises an inner component profile configured for opening and closing with a key having a corresponding external profile, wherein the inner component profile extends axially at least part way along the screw section, and wherein the inner component profile extends axially from between 50% to 90% of the screw section; and wherein the screw top tube comprises a hollow cylindrical section having an open end, a closed end and an internal thread that is adapted to be engaged with the external thread of the screw cap and sealed by the screw cap at the open end, and wherein the hollow cylindrical section has a tube axis and a tube longitudinal direction.

2. The system according to claim 1, wherein the screw cap and the screw top tube are made from materials such that the screw cap and the screw top tube have at least one material in common.

3. The system according to claim 1, wherein the screw cap and the screw top tube are made from materials such that the screw cap and the screw top tube have all materials in common.

4. The system according to claim 1, wherein the screw top tube comprises polypropylene.

5. The system according to claim 1, wherein the screw section of the screw cap has a length and the flange portion of the screw cap has a length, and wherein the length of the screw section divided by the length of the flange portion provides a ratio that is between 1.4 and 3.4.

6. The system according to claim 1, wherein the inner component profile of the screw cap extends axially between 60% to 80% of the screw section of the screw cap.

7. The system according to claim 1, wherein the inner component profile of the screw cap extends axially over 70% of the screw section of the screw cap.

8. The system according to claim 1, wherein the flange portion is essentially cylindrical and has a larger external diameter than the screw section.

9. The system according to claim 1, wherein the external thread is designed for about 0.7 to 1.3 turns.

10. The system according to claim 1, wherein the screw cap has a total length between 5.2 mm and 8.0 mm longitudinally along the longitudinal axis.

11. The system according to claim 1, wherein the flange portion is of a length that is between 1.4 mm and 2.4 mm.

12. The system according to claim 1, wherein the external thread extends longitudinally between 70% and 100% of the length of the screw section.

13. The system according to claim 1, wherein the screw cap comprises plastic.

14. The system according to claim 13, wherein the screw cap comprises polypropylene.

15. The system according to claim 1, wherein the screw cap further comprises a sealing ring made from silicone, TPE, or TPV.

* * * * *